US008505838B2

(12) United States Patent
Schaefer et al.

(10) Patent No.: US 8,505,838 B2
(45) Date of Patent: Aug. 13, 2013

(54) ELECTRIC INTERLOCK FOR SPREADER

(75) Inventors: Bob Schaefer, Cherry Valley, IL (US); Eric Larsen, Cortland, IL (US); Roland Hagemeyer, Rochelle, IL (US)

(73) Assignee: Louis Berkman Company, Steubenville, OH (US)

( * ) Notice: Subject to any disclaimer, the term of this patent is extended or adjusted under 35 U.S.C. 154(b) by 224 days.

(21) Appl. No.: 12/978,675

(22) Filed: Dec. 27, 2010

(65) Prior Publication Data

US 2012/0160929 A1 Jun. 28, 2012

(51) Int. Cl.
*A01C 19/00* (2006.01)

(52) U.S. Cl.
USPC ..... 239/675; 239/655; 239/654; 239/664; 239/681; 239/683; 239/672; 439/180

(58) Field of Classification Search
USPC ..... 239/655, 654, 664, 681, 683, 689, 239/672, 675; 439/180
See application file for complete search history.

(56) References Cited

U.S. PATENT DOCUMENTS

| | | | | |
|---|---|---|---|---|
| 6,123,276 | A * | 9/2000 | Ungerer et al. | 239/675 |
| 6,220,532 | B1 * | 4/2001 | Manon et al. | 239/672 |
| 6,978,952 | B2 | 12/2005 | Kost et al. | |
| 7,530,777 | B2 | 5/2009 | Hintzsche et al. | |
| 2005/0014404 | A1 * | 1/2005 | Cecchi | 439/180 |

* cited by examiner

*Primary Examiner* — Jason Boeckmann
*Assistant Examiner* — Joel Zhou
(74) *Attorney, Agent, or Firm* — Roger D. Emerson; Timothy D. Bennett; Emerson Thomson Bennett

(57) ABSTRACT

A material spreader may include an electric interlock mechanism that is adjustable between: (1) a first condition where an electric supply line can supply electricity to operate a material transfer member and a door cannot be moved into an open position; and, (2) a second condition where the electric supply line cannot supply electricity to operate the material transfer member and the door can be moved into an open position.

4 Claims, 4 Drawing Sheets

ELECTRIC INTERLOCK FOR SPREADER

I. BACKGROUND

A. Field of Invention

This invention relates to the art of spreaders and more specifically to methods and apparatuses related to an electric interlock that prevents a door from being opened unless operation of the spreader has been stopped.

B. Description of the Related Art

The spreading of materials, such as sand, salt, cinders and other granular material, is a common practice to maintain roads, drive ways, parking lots, and other ground surfaces. Typically, a material spreading device (often referred to as a "material spreader" or simply as a "spreader") is mounted to the rear of a vehicle. The vehicle is then driven along the ground surface that needs maintained and the granular material is released or spread onto the ground surface.

Typically, there are one or more doors or covers that provide access to the inside of the spreader for maintenance purposes. If such doors were to be opened during operation of the spreader, however, safety concerns arise as it is possible that the operator could become injured if a component within the spreader, such as a rotating auger, was inadvertently contacted. In order to prevent such injuries spreaders may be provided with safety systems. One known safety system is a hydraulic safety system that works with the hydraulic system that provides hydraulic fluid to operate the auger. In general, the hydraulic safety system works by stopping the flow of hydraulic fluid to thereby disable the auger in the event that a door is opened during operation of the auger. While known spreader safety systems work well for their intended purposes, additions and improvements are desirable.

In particular, what is needed is a safety system that works with electric systems used in the operation of spreaders.

II. SUMMARY

According to one embodiment of this invention, a material spreader may comprise: a frame comprising a surface that is attachable to an associated vehicle; a material transfer member that is movably supported to the frame; a first door that is movable with respect to the frame between: (1) a first closed position where the first door covers at least a portion of the material spreader; and, (2) a second open position where the first door does not cover the at least a portion of the material spreader; an electric supply line that supplies electricity that is used to operate the material transfer member to transfer material out of the associated vehicle and onto an associated ground surface; and, an electric interlock mechanism that is adjustable between: (1) a first condition where the electric supply line can supply electricity to operate the material transfer member and the first door cannot be moved into the second open position; and, (2) a second condition where the electric supply line cannot supply electricity to operate the material transfer member and the first door can be moved into the second open position.

According to another embodiment of this invention, a material spreader may comprise: a frame comprising a surface that is attachable to an associated vehicle; an auger that is rotatably supported to the frame and used to transfer an associated granular material from the associated vehicle to an associated ground surface; a first door that is movable with respect to the frame between: (1) a first closed position where the first door covers at least a portion of the auger; and, (2) a second open position where the first door does not cover the at least a portion of the auger; an electric power supply supported to the frame; an electric supply line that supplies electric power from the electric power supply to the auger to operate the auger; and, an electric interlock mechanism comprising: (A) a first member electrically attached to a first portion of the electric supply line; (B) a second member electrically attached to a second portion of the electric supply line; and, physically supported to the first door so that the second member moves with the first door as the first door is moved between the first closed position and the second open position; and, (C) wherein the electric interlock mechanism is adjustable between: (1) a first condition where: the first member is electrically engaged to the second member; the electric supply line can supply electric power to operate the auger; and, the first door cannot be moved into the second open position; and, (2) a second condition where: the first member is electrically disengaged from the second member; the electric supply line cannot supply electric power to operate the auger; and, the first door can be moved into the second open position.

According to yet another embodiment of this invention, a method may comprise the steps of: (A) providing a material spreader comprising: a frame comprising a surface that is attachable to an associated vehicle; a material transfer member that is movably supported to the frame; a first door that is movable with respect to the frame between: (1) a first closed position where the first door covers at least a portion of the material spreader; and, (2) a second open position where the first door does not cover the at least a portion of the material spreader; and, an electric supply line that supplies electricity that is used to operate the material transfer member to transfer material out of the associated vehicle and onto an associated ground surface; (B) providing an electric interlock mechanism; and, (C) adjusting the electric interlock mechanism from: (1) a first condition where the electric supply line can supply electricity to operate the material transfer member and the first door cannot be moved into the second open position; to, (2) a second condition where the electric supply line cannot supply electricity to operate the material transfer member and the first door can be moved into the second open position.

Benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
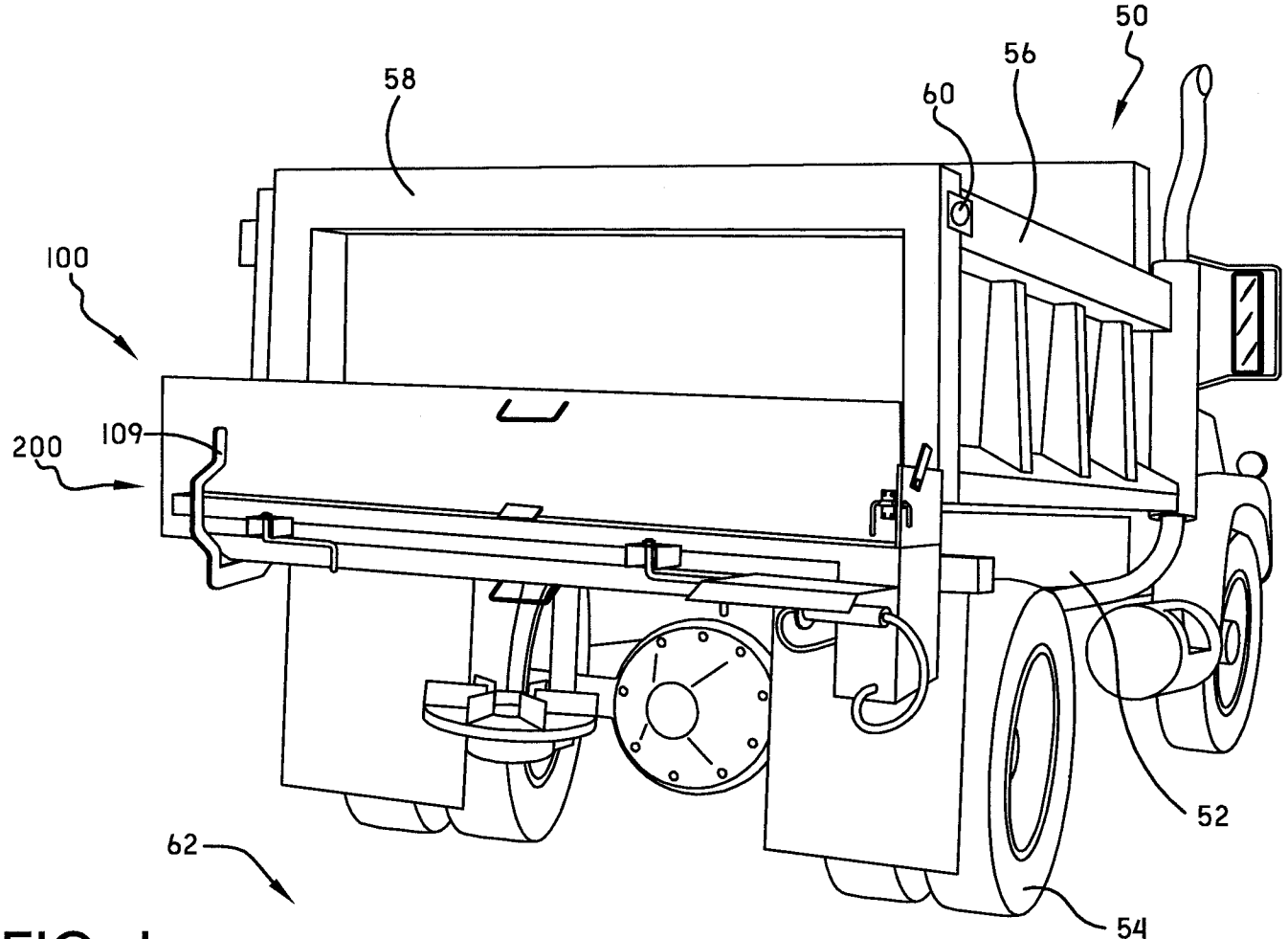
FIG. 1 is a back perspective view of a material spreader mounted to the back of a truck.

Referring now to the drawings wherein the showings are for purposes of illustrating embodiments of the invention only and not for purposes of limiting the same, and wherein like reference numerals are understood to refer to like components, FIG. 1 shows a vehicle 50 that may be equipped with a material spreader 100 using an electric interlock mechanism 200 according to this invention. While the vehicle 50 shown is a dump truck, and the material spreader 100 shown is commonly referred to as a tailgate spreader or an under tailgate spreader, it should be understood that the electric interlock mechanism 200 of this invention will work with any spreader attached to any vehicle chosen with the sound judgment of a person of skill in the art.

With continuing reference to FIG. 1, the vehicle 50 may include a frame 52 and one or more ground engaging wheels 54 mounted to the frame 52 that maintain the vehicle 50 to a ground surface 62. The vehicle may also have a dump body 56 mounted to the frame 52, for use in holding and dumping materials as is well known in the art. A tailgate 58 may be pivotally attached via pivot shafts 60 to the back end of the dump body 56. Granular material may be held in the dump body 56 and moved via a conveyor (not shown) and/or via the dumping action of the dump body 56 through the tailgate 58 and into the spreader 100 in any manner chosen with the sound judgment of a person of skill in the art.

Figure 2:
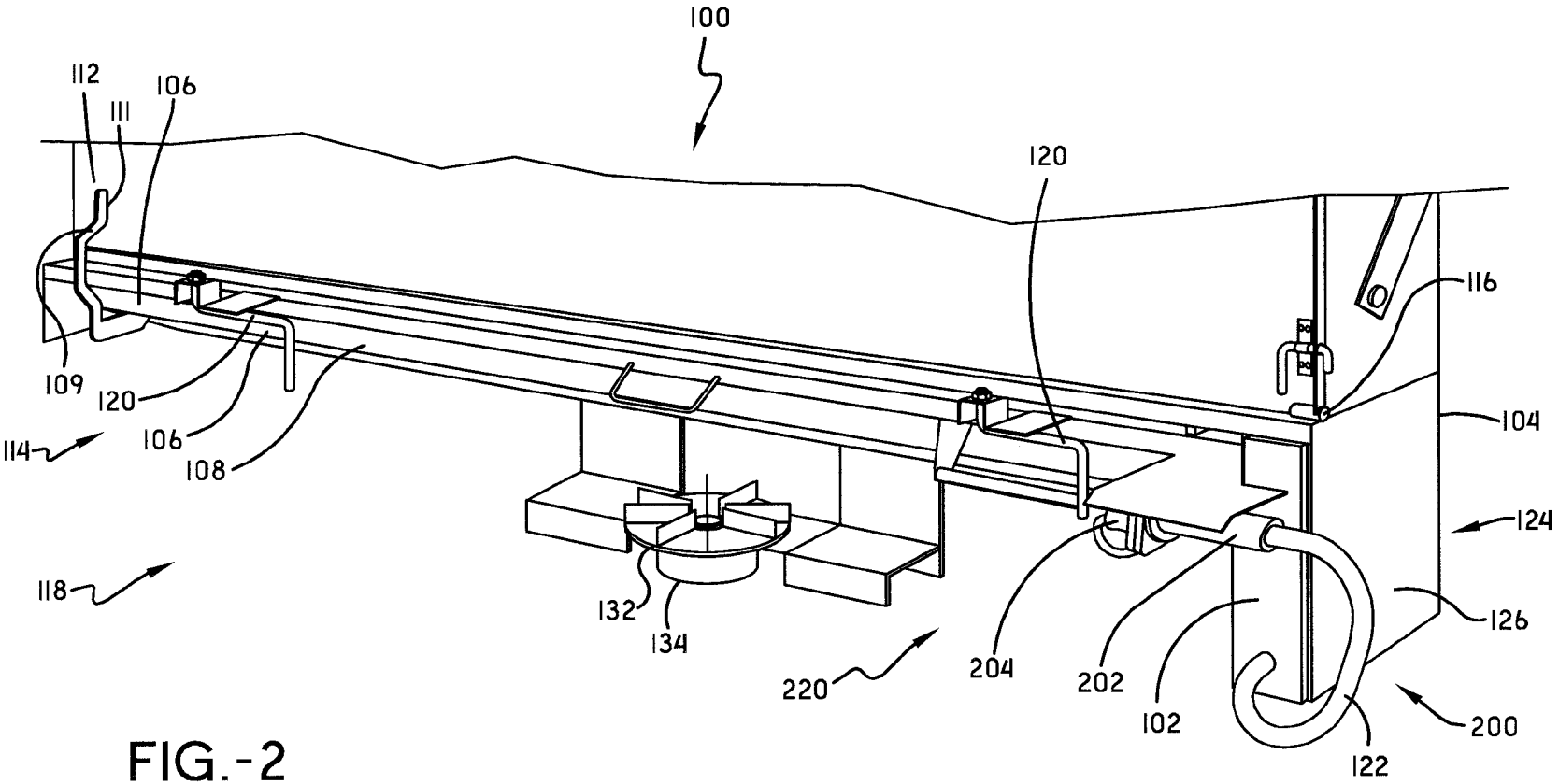
FIG. 2 is a back perspective view of a material spreader shown with a door in a closed position.
Figure 3:
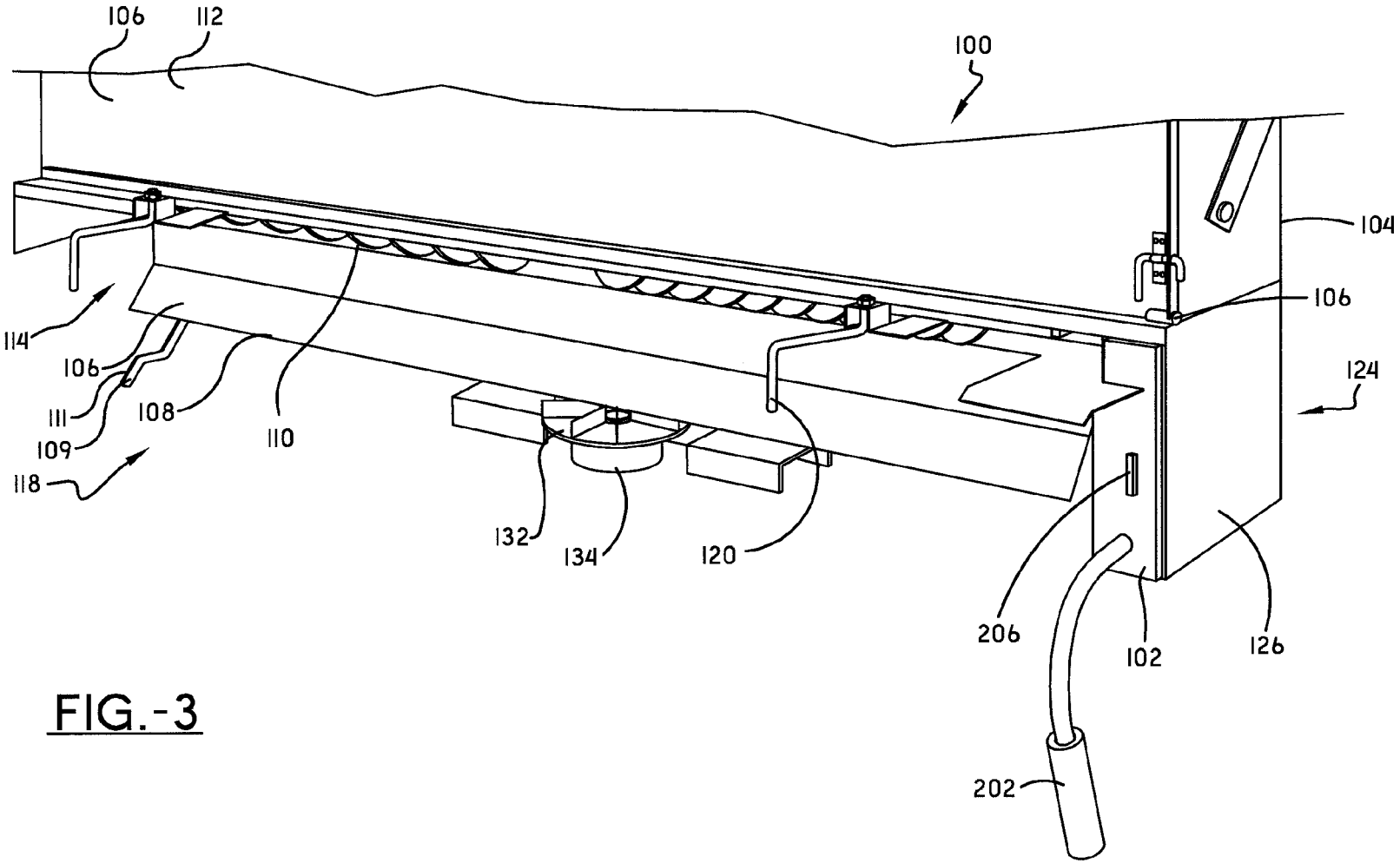
FIG. 3 is a back perspective view of a material spreader similar to that shown in FIG. 2 but with the door in an open position.

With reference now to FIGS. 1-3, the material spreader 100 may include a main body or frame 102 having a surface (or surfaces) 104 that is attachable to the vehicle 50. The surface 104 may be attachable to the vehicle 50 in any manner chosen with the sound judgment of a person of skill in the art. For the embodiment shown, the surface 104 is bolted to the dump body 56 just below the tailgate 58 in a known manner. A material transfer member 110 (visible in FIG. 3) may be movably supported to the frame 102 and used to transfer material out of the vehicle 50 and onto the ground surface 62. The material transfer member 110 can be of any type and size chosen with the sound judgment of a person of skill in the art. For the embodiment shown, the material transfer member 110 is a single auger that is rotatably supported to the frame 102 in a known manner. It is also contemplated to use multiple augers or to use other types of material transfer members including, for some non-limiting examples, chain drives and conveyors. The material spreader 100 may also have an optional spinner mechanism 132 supported to the frame 102 and including a spinner motor 134. The spinner motor 134 operates the spinner mechanism 132 to spread the material from the material transfer member 110 onto the ground surface 62 in a broader manner than can typically be achieved using an auger alone. As the basic operation and purposes for material transfer members and spinner mechanisms are well known to those of skill in the art, further details will not be provided here.

With reference now to FIGS. 2-3, the material spreader 100 may include at least one door 106 that is movable with respect to the frame 102 between: (1) a closed position where the door 106 covers at least a portion of the material spreader 100 (see, for example, door 108 in FIG. 2); and, (2) an open position where the door 106 does not cover the material spreader 100 (see, for example, door 108 in FIG. 3). The door 106 may be opened, for example, to provide access to the auger 110 or other spreader component for maintenance purposes. The door 106 used can be of any number, type and size chosen with the sound judgment of a person of skill in the art. For the embodiment shown there are two doors, bottom door 108 and top door 112, that are pivotally connected to the frame 102 via hinges 114, 116 respectively. An opening mechanism 118 may be provided to assist with the opening of one or both of the doors 108, 112. The opening mechanism 118 can be of any type and size chosen with the sound judgment of a person of skill in the art. For the embodiment shown, opening mechanism 118 includes a pair of manually activated handles 120, 120 which can be rotated by an operator to permit both doors 108, 112 to be opened. There may be an exception, however, whereby activation of the handles 120, 120 is insufficient to open the doors 108, 112. This will be discussed further below.

Figure 4:
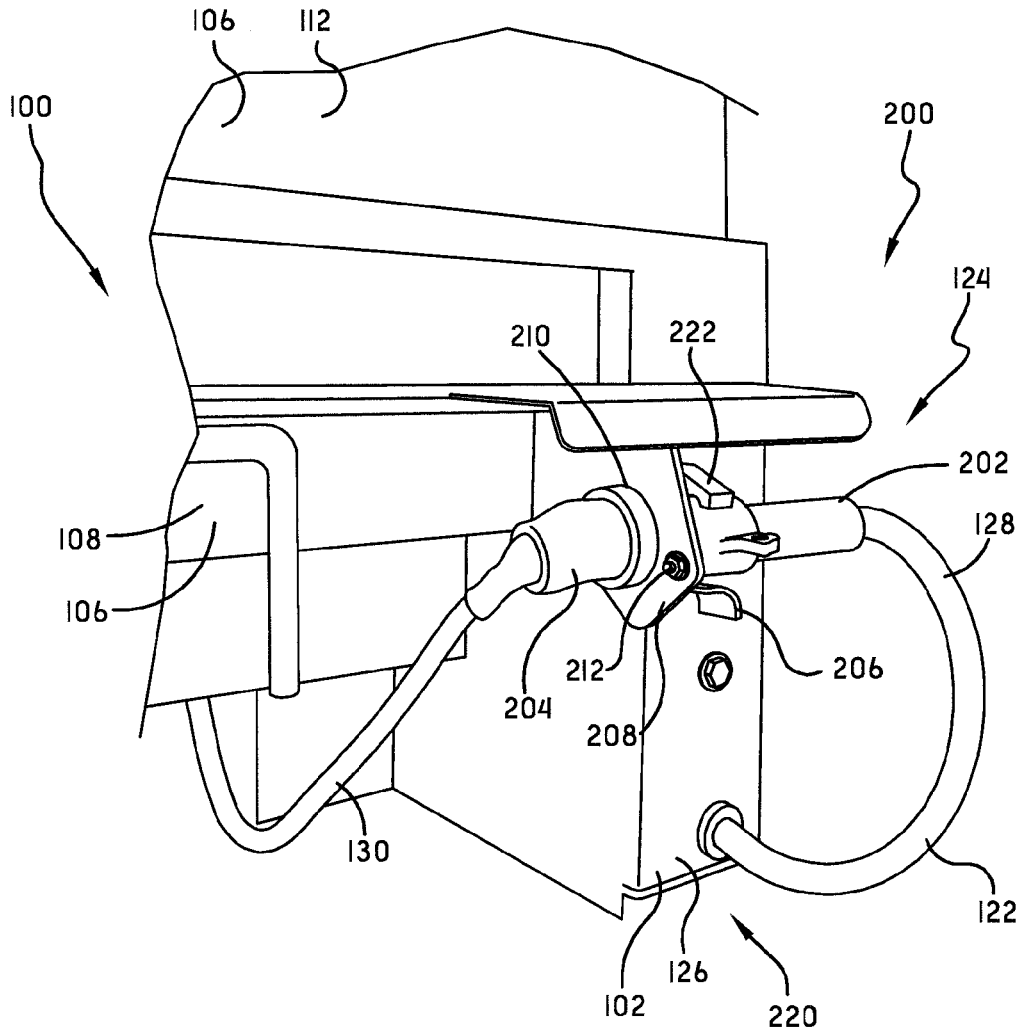
FIG. 4 is a close-up perspective view of an electric interlock mechanism.

With reference now to FIGS. 2-4, the material spreader 100 may also include at least one electric supply line 122 that supplies electricity that is used to operate the material transfer member 110. The electric supply line 122 used can be of any number, type and size chosen with the sound judgment of a person of skill in the art. For the embodiment shown, the electric supply line 122 supplies electric power from an electric power supply 124, supported to the frame 102 within housing 126, to an auger 110 motor (not shown) to operate the auger 110 as is known to those of skill in the art. It is also contemplated, however, to use an electric supply line 122 that does not supply power to the material transfer member 110 (or to any other component). In one embodiment, for example, the electric supply line 122 may be used for control purposes. In one specific embodiment, not shown, the electric supply line 122 may be used to control one or more solenoid valves used in a hydraulic system to operate the material transfer member 110 (or other component).

With continuing reference to FIGS. 2-4, the material spreader 100 may also include the electric interlock mechanism 200 that is adjustable between: (1) a first condition where the electric supply line 122 can supply electricity to operate the material transfer member 110 and the door 106 cannot be moved into the open position (shown in FIGS. 2 and 4); and, (2) a second condition where the electric supply line 122 cannot supply electricity to operate the material transfer member 110 and the door 106 can be moved into the open position (shown in FIG. 3). In this way the electric interlock mechanism 200 serves as a safety system. Specifically, in the first condition the auger or other material transfer member 110 is operable (because electricity may be supplied via the electric supply line 122) to transfer material but the door 106 cannot be opened (or at least cannot be fully opened). In the second condition, however, the auger or other material transfer member 110 cannot be operated because electricity flow within the electric supply line 122 is prevented (or at least limited with the result of stopping operation of the material transfer member 110) but the door 106 can be opened. Contact of the material transfer member 110 is thus prevented while the material transfer member 110 operates because the door 106 cannot be opened. Once the operation of the material transfer member 110 has been stopped, however, (by preventing or limiting electricity flow within electric supply line 122) the door 106 can be opened and operators can easily access the material transfer member 110 or other material spreader 100 components.

Still referring to FIGS. 2-4, the electric interlock mechanism 200 can be of any type and size chosen with the sound judgment of a person of skill in the art. For the embodiment shown, the electric interlock mechanism 200 has a first member 202 electrically attached to a first portion 128 of the electric supply line 122 and a second member 204 electrically attached to a second portion 130 of the electric supply line 122. To achieve the first condition of the electric interlock mechanism 200, the first member 202 is electrically engaged to the second member 204. This electrical engagement can be accomplished in any manner chosen with the sound judgment of a person of skill in the art. For the embodiment shown, the first member 202 can be "plugged into" the second member 204 similar to the manner in which an electrical appliance cord can be plugged into a wall outlet. To achieve the second condition of the electric interlock mechanism 200, the first member 202 is electrically disengaged from the second member 204. This electrical disengagement can be accomplished in any manner chosen with the sound judgment of a person of skill in the art. For the embodiment shown, the first member 202 can be unplugged from the second member 204. The first member 202 may be, as shown, a "male" component that is received within an opening formed in the "female" component, second member 204.

With continuing reference to FIGS. 2-4, while previous paragraph describes how the electric interlock mechanism 200 can be used to supply or limit the supply of electricity within the electric supply line 122, the manner in which the electric interlock mechanism 200 can simultaneously be used to permit or limit the opening of the door 106 will now be described. This can be accomplished in any manner chosen with the sound judgment of a person of skill in the art. In one embodiment, this may be accomplished, when the electric interlock mechanism 200 is in the first condition, by supporting one of the first and second members 202, 204 to the door 106 (or at least one of the doors 108, 112) and the other of the first and second members 202, 204 to a portion of the material spreader 100 that does not move with the door 106. In this way, as long as the first and second members 202, 204 are electrically engaged, the door 106 cannot be moved (significantly) with respect to the material spreader 100 (even if the handles 120, 120 are activated). In a specific embodiment, seen best in FIG. 4, a first bracket 206 is fixedly attached to the frame 102 and a second bracket 208 is fixedly attached to the door 106. These fixed attachments can be made in any manner chosen with the sound judgment of a person of skill in the art, such as by welding the brackets 206, 208 to the frame 102 and door 108, respectively.

With continuing reference to FIGS. 2-4, when the electric interlock mechanism 200 is in the first condition, the first member 202 may be physically supported to the frame 102 via bracket 206 and the second member 204 may be physically supported to the door 106 via bracket 208. This physical support can be made in any manner chosen with the sound judgment of a person of skill in the art. For the embodiment shown, the first member 202 simply rests or sits on the bracket 206 when the electric interlock mechanism 200 is in the first condition. The bracket 208 may have an opening 210 that receives a portion of the second member 204. The second member 204 may then be attached to the bracket 208 with bolts 212. With this arrangement, the second member 204 is physically supported to and moves with the door 106 when the door 106 is moved between the closed position and the open position.

With reference now to FIG. 4, to reduce the chances of inadvertent disengagement of the first and second members 202, 204, a latch mechanism 220 may be provided to prevent such disengagement unless the operator first makes a manual adjustment. The latch mechanism 220 can be made in any manner chosen with the sound judgment of a person of skill in the art. For the embodiment shown, the latch mechanism 220 includes a latch member 222, operatively attached to the second member 204, that prevents the electric interlock mechanism 200 from being adjusted into the second condition unless the latch member 222 is first manually adjusted. According the embodiment shown, the latch member 222 may be raised relative to the first member 202 to "unlatch" the latch mechanism 220 in a known manner so that the first member 202 can then be easily manually disengaged from the second member 204 by simply pulling the first member 202 away from the second member 204. More specifically, the operator may raise the latch member 222 with one hand and then, while maintaining the latch member 220 in the raised position, pull the first member 202 away from the second member 204 with the other hand.

With reference now to FIGS. 2-4, once the electric interlock mechanism 200 has been adjusted into the second condition, with the latch mechanism 220 (if used) unlatched and the first member 202 disengaged from the second member 204, the door 106 can be readily opened to provide access to the auger 110. If an opening mechanism 118 is used, it may have to be adjusted, such as by manually activating handles 120, 120, to allow the door 106 to be opened. To return the electric interlock mechanism 200 back to the first condition, it is only necessary to close the door 206, readjust the opening mechanism 118 (if used), and engage the first member 202 to the second member 204 (such as by inserting the first member 202 into the second member 204—this may automatically engage the latch mechanism 220).

With reference now to FIGS. 1-3, in one embodiment the bottom door 108 prevents the top door 112 from being opened unless the bottom door 108 is first opened. While this may be accomplished in any manner chosen with the sound judgment of a person of skill in the art, for the embodiment shown, a stop member 109 extends from the bottom door 108 and has a contact surface 111 that prevents the top door 112 from being opened. Specifically, as long as the bottom door 108 is in a closed position, the stop member 109 is juxtaposed to the top door 112. If someone tried to open the top door 112 while the bottom door was in the closed position, the top door 112 would contact the contact surface 111 of the stop member 109. This contact prevents the top door 112 from being opened. When the bottom door 108 is in an open position, however, the stop member 109 is moved away from the top door 112 thereby permitting the top door 112 to be opened.

Numerous embodiments have been described, hereinabove. It will be apparent to those skilled in the art that the above methods and apparatuses may incorporate changes and modifications without departing from the general scope of this invention. The electric interlock mechanism 200 may be used, for example, to also adjust the spinner motor 134 between operable and inoperable conditions It is intended to include all such modifications and alterations in so far as they come within the scope of the appended claims or the equivalents thereof.

Having thus described the invention, it is now claimed:

1. A material spreader comprising:

a frame comprising a surface that is attachable to an associated vehicle;

an auger that is rotatably supported to the frame and used to transfer an associated granular material from the associated vehicle to an associated ground surface;

a first door that is movable with respect to the frame between: (1) a first closed position where the first door covers at least a portion of the auger; and, (2) a second open position where the first door does not cover the at least a portion of the auger;

an electric power supply supported to the frame;

an electric supply line that supplies electric power from the electric power supply to the auger to operate the auger; and, an electric interlock mechanism comprising:

(A) a first member electrically attached to a first portion of the electric supply line;

(B) a second member electrically attached to a second portion of the electric supply line; and, physically supported to the first door so that the second member moves with the first door as the first door is moved between the first closed position and the second open position; and, (C) wherein the electric interlock mechanism is adjustable between: (1) a first condition where: the first member is electrically engaged to the second member; the electric supply line can supply electric power to operate the auger; and, the first door cannot be moved into the second open position; and, (2) a second condition where: the first member is electrically disengaged from the second member; the electric supply line cannot supply electric power to operate the auger; and, the first door can be moved into the second open position; and a second door that is pivotal with respect to the frame between: (1) a first closed position where the second door covers at least a portion of the auger; and, (2) a second open position where the second door does not cover the at least a portion of the auger;

wherein: (1) when the electric interlock mechanism is in the first condition the second door cannot be moved into the second open position; and, (2) when the electric interlock mechanism is in the second condition the second door can be moved into the second open position;

wherein the first door is pivotal with respect to the frame between the first closed position and the second open position; and wherein the first door comprises a stop member that prevents the second door from being opened unless the first door is first opened.

2. The material spreader of claim 1 wherein the electric interlock mechanism comprises:

a latch mechanism comprising a latch member; and, wherein the latch mechanism prevents the electric interlock mechanism from being adjusted into the second condition unless the latch member is first manually adjusted.

3. The material spreader of claim 2 wherein the latch mechanism prevents the first member from being electrically disengaged from the second member unless the latch member is first manually adjusted.

4. The material spreader of claim 1 further comprising:

a first bracket fixedly attached to the frame;

a second bracket fixedly attached to the first door;

wherein the first member is physically supported by the first bracket when the electric interlock mechanism is in the first condition; and, wherein the second member is physically supported by the second bracket.

* * * * *